US006779850B1

(12) United States Patent
Schibeci et al.

(10) Patent No.: US 6,779,850 B1
(45) Date of Patent: Aug. 24, 2004

(54) CUTTING APPARATUS HAVING MEANS FOR SHIELDING CUTTING TOOL HOLDERS

(75) Inventors: Anthony Richard Schibeci, Victoria (AU); Anthony Richard Schibeci, Jr., Victoria (AU); Joseph Mark Schibeci, Victoria (AU)

(73) Assignee: Anthony Richard Schibeci Watsonia, Victoria (AU)

( * ) Notice: Subject to any disclaimer, the term of this patent is extended or adjusted under 35 U.S.C. 154(b) by 0 days.

(21) Appl. No.: 09/573,819

(22) Filed: May 18, 2000

(30) Foreign Application Priority Data

May 18, 1999 (AU) ..... PQ 0426

(51) Int. Cl.[7] ..... E21C 25/10

(52) U.S. Cl. ..... 299/87.1; 299/102; 299/104; 299/106; 299/110

(58) Field of Search ..... 37/465; 299/102–104, 299/106–107, 110, 34.01, 39.4, 39.8, 39.9, 40.1, 51, 82.1, 87.1; 175/394

(56) References Cited

U.S. PATENT DOCUMENTS

| | | | | | |
|---|---|---|---|---|---|
| 318,962 | A | * | 6/1885 | Crump et al. | 299/39.8 |
| 2,017,457 | A | * | 10/1935 | Hamilton | 299/82.1 |
| 2,391,485 | A | * | 12/1945 | Simmons | 299/82.1 |
| 3,398,989 | A | * | 8/1968 | Christensen | 299/39.9 |
| 3,847,439 | A | * | 11/1974 | Allen | 299/87.1 |
| 4,411,475 | A | * | 10/1983 | Best et al. | 299/87.1 X |
| 4,678,238 | A | * | 7/1987 | Emmerich | 299/102 |
| 4,728,153 | A | * | 3/1988 | Ojanen et al. | 299/107 |
| 5,018,793 | A | * | 5/1991 | Besten | 299/107 |
| 5,088,797 | A | * | 2/1992 | O'Neil | 299/104 |
| 5,230,548 | A | * | 7/1993 | Southern | 299/104 |
| 5,322,351 | A | | 6/1994 | Lent | |
| 5,842,747 | A | | 12/1998 | Winchester | |
| 5,904,408 | A | | 5/1999 | Olson et al. | |

FOREIGN PATENT DOCUMENTS

| | | | |
|---|---|---|---|
| DE | 2644992 | * | 4/1978 |
| DE | 4210353 | | 10/1993 |
| DE | 19754371 | | 11/1998 |
| EP | 0245810 | | 11/1987 |
| EP | 0771911 | | 5/1997 |
| FR | 2781170 | | 1/2000 |
| SU | 1678947 | | 9/1991 |

* cited by examiner

*Primary Examiner*—Heather Shackelford
*Assistant Examiner*—Sunil Singh
(74) *Attorney, Agent, or Firm*—Burns, Doane, Swecker & Mathis, LLP

(57) ABSTRACT

A cutting apparatus which includes a rotatable member having an outer surface and a plurality of cutting tool assemblies, wherein each assembly includes a cutting tool mounted in a holder. The cutting tool assemblies are mounted on the rotatable member so that the holder is shielded by the rotatable member, wherein the cutting tool extends beyond the outer surface of the rotatable member a sufficient distance to operate as a cutter.

36 Claims, 10 Drawing Sheets

CUTTING APPARATUS HAVING MEANS FOR SHIELDING CUTTING TOOL HOLDERS

The present invention relates to a cutting apparatus for use in a cutting machine, and to a block for use in a cutting apparatus.

Cutting machines are used in a variety of applications including mining, digging and earth working operations. One application of a cutting machine in the removal of asphalt surfaces from roads. The cutting apparatus of a cutting machine is coupled to a drive mechanism which drives or otherwise rotates the cutting apparatus.

A known cutting apparatus of the prior art includes a cutting drum which is commonly, although by no means exclusively, generally cylindrical in shape. The cutting apparatus has disposed about its surface a number of cutting assemblies comprising a cutting tool mounted in a holder. The cutting tool assemblies are welded, bolted or otherwise attached to the radially outer surface of mounting blocks which extend from the cutting drum. These bulky mounting block and cutting tool assemblies are staggered about the surface of the drum.

When operating the cutting machine, the projecting portions of the cutting apparatus including the cutting tool assemblies hit various parts of the material being removed or excavated. In the particular application of a cutting machine used to remove a road surface, there are hidden obstructions under the surface of the road that are hit by the cutting machine including sewer drains, manhole pits, stormwater covers, steel bars including train and tram tracks, and water mains shut-off valves. When various portions of the machinery hit particularly hard obstructions, various parts of the cutting apparatus break away. The holder is usually the weakest point of the cutting apparatus, and accordingly the holders are commonly broken and must be replaced. In addition, a great deal of strain is placed on the drive mechanism as the bulky parts of the cutting apparatus strike these obstructions, sometimes preventing the cutting apparatus from rotating.

Taking a cutting machine out of operation for repair of the cutting apparatus is a very costly exercise. One expensive cost component associated with repairing the cutting machine is the loss of potential revenue which cannot be obtained while the cutting machine is out of operation.

Various techniques have been developed in order to simplify the replacement of holders on a cutting apparatus in a cutting machine. One method involves the use of a holder having a T-shaped shank which can be slidably inserted into a base portion which is welded directly onto the mounting block. When the holder breaks away, any remaining portion of the holder can be slid out of the base a new holder can be reinserted. This does to some extent reduce the amount of time taken to repair the cutting apparatus.

Another problem associated with known cutting apparatus is that as the cutting apparatus is rotated, the various bulky protruding sections of the apparatus come into contact with the surface being worked a cause considerable stress on the drive mechanism which drives the cutting apparatus. Repairing the drive mechanism can be costly and time consuming.

It is accordingly desirable to provide a cutting apparatus which is relatively simple to repair to minimise the time during which the cutting machine is out of operation.

According to the present invention there is provided a cutting apparatus which includes:

a rotatable member having an outer surface; and a plurality of cutting tool assemblies, each assembly including a cutting tool mounted in a holder, wherein the cutting tool assemblies are mounted on the rotatable member so that the holder is shielded by the rotatable member and the cutting tool extends beyond the outer surface of the rotatable member a sufficient distance to operate as a cutter.

As is well known in the art of the invention, holders are usually used for receiving cutting tools because the cutting tools generally need to be received in a region of high-strength (and therefore higher quality and more expensive) metal. It is generally cheaper to provide a separate holder of high-strength material, rather than an entire rotatable member made from high strength material. However, it is possible for the holder to be integral with the rotatable member. In this case, the rotatable member could be made entirely from the high-strength steel, and a region of this member which receives and supports the cutting tool constitutes the holder of the cutting tool assembly.

By providing a rotatable member which shields the holder of the cutting tool assembly the problem associated with breaking cutting holders is avoided. In particular, when only the cutting tool extends beyond the outer surface of the rotatable member, only the cutting tool is subjected to forces which may result in breakage. The cutting tool can be simply and inexpensively replaced by removal of any broken portion of the cutting tool and replacement with a new cutting tool.

It is less expensive to replace a cutting tool than the entire holder or block of the rotatable member of the prior art. The cutting tool is approximately eight times less expensive than the holder. In addition, according to a preferred embodiment, the cutting tool is merely seated with a retaining clip in the holder and is not bolted, welded or otherwise affixed rigidly thereto. It takes much less time to replace the cutting tool than it does to replace the entire cutting tool assembly or block. In the prior art, when the holder or block breaks, this must be re-welded or bolted onto the mounting block. This takes much more time, and often cannot be done on site.

Preferably, the shielding is provided in a region to the side of and/or in front of the holder in the direction of rotation of the rotatable member. The shielding may be provided in a region diagonally in front and to the side of the holder, in the direction of rotation of the rotational member.

Preferably, the portion of the rotatable member defining the outer surface of the rotatable member shields the holder.

It is preferred that the outer surface of the rotatable member be substantially continuous in the sense that any breaks or crevices in the outer surface are not so large or are not located so as to cause stress on the mechanism driving the rotatable member. The idea behind this is that the rotating outer surface of the rotatable element should ride relatively smoothly over the surface being removed, with only the cutting teeth extending beyond the outer surface and into the material being cut. Accordingly, it may be possible for there to be small breaks or irregularities in the outer surface, provided that the arrangement of these breaks is not much as to alter the relatively smooth rotation of the outer surface over the surface being cut. Accordingly, it is a preferred feature of the invention that the outer surface of the rotatable member be shaped to enable the rotatable member to maintain continuous contact with the surface being cut as it rotates in a cutting operation. More preferably, the rotatable member maintains smooth continuous contact with the surface being cut during the cutting operation.

The object of this embodiment is to ensure that the teeth do the work in cutting the surface being cut, and not any irregular or protruding parts of the cutting apparatus. This also ensures that the rotational driving force is primarily transferred into cutting force as exposed to stress forces arising from irregular contact with the surface being cut.

It is particularly advantageous to provide smooth continuous contact between the rotatable member and the surface being cut, since this substantially reduces the impact loading on the drive mechanism for the rotating cutting apparatus, and ensures that the cutting tools principally do the cutting work, and are subjected to the stress of striking the surface being cut. In one commonly known cutting apparatus, the bulky mounting block and cutting tool assemblies are unevenly randomly distributed about the surface of the rotatable drum. This results in irregular impact and strain being applied to the drive mechanism an to the cutting apparatus itself.

It is particularly preferred that the outer surface of the cutting apparatus forms a spiral or helix. For example, the outer surface of the cutting apparatus may be in the form of two helices which start at the outer edges of the rotatable member and wind inwardly towards the centre of the rotatable member. Other various arrangements are also possible. For example, the outer surface may include a number of interposed or meshing spirals or helices. The spiral(s) or helix (helices) may have a constant or varying angle of intersection to the axis of the rotatable member.

It has been explained above that it is preferred that the outer surface of the rotatable member be shaped to ensure that the rotatable member maintains continuous (and smooth) contact with the surface being cut as it rotates in a cutting operation. In the situation where the outer surface is generally spiral or helical, this may be brought into effect by having a continuous outer surface of constant radius (for generally cylindrical rotatable members) or smoothly increasing radius (for generally conical or "pineapple-shaped" rotatable members).

It is possible for the cutting tools in this situation to be located to one side of the helix or to be recessed into the helix in alignment with the helix. When the cutting tools are in line with the helix (thereby forming a small break in the outer surface), it is still possible for the rotatable member to maintain continuous and smooth contact with the surface being cut. This is achieved by having a sufficient number of sections of the outer surface extending laterally across (eg. when cylindrical) or around (eg. when conical) the rotatable member having a uniform radius. There should be enough of these sections laterally in line with one another to compensate for any broken sections in the same lateral plane to enable the rotatable member to maintain continuous a smooth contact with the surface being cut.

Preferably the cutting tools are evenly distributed about the surface of the cutting apparatus.

Preferably the rotatable element comprises a rotatable drum and a housing mounted to the drum, wherein the outer surface of the housing forms the outer surface of the rotatable element. Accordingly, in one form of the invention, the rotatable member is in the form of a drum having a helical upstanding ridge. The drum may of of any suitable shape, including cylindrical, conical and "pineapple" shapes.

When the drum is cylindrical, it is preferred that the radial distance from the axis of the rotatable drum to the outer surface of the housing is substantially constant along the length of the rotatable drum. It is not necessary for the radial distance to be absolutely constant. For example, there may be a small variations or irregularities in this radial distance. It is envisaged however that the variation in the radial distance will not be so substantial as to provide such an irregular surface that there will be irregular and unbalanced contact between the housing and the surface being cut.

Preferably the housing of the cutting apparatus has a side surface that is substantially constant (even). The provision of the substantial constant side surface for the housing facilitates removal of the cut material through the helical spiral of the cutting apparatus and with minimum resistance or drag caused by any uneven surfaces. This streamlining of the side surfaces has been found by the applicant to improve the operating efficiency of the cutting apparatus.

Preferably the housing includes a series of blocks, each bearing one of the cutting tool assemblies. Preferably, each block constitutes a segment of a ring.

Preferably the holder is seated within an aperture in the rotatable element.

Preferably the holder includes a channel which receives a shalt of the cutting tool to enable mounting of cutting tool in the holder.

Preferably the aperture in which the holder is seated is aligned with the channel in the holder.

Preferably the rotatable body includes a cavity located at an inner end of the aperture that opens to the aperture and, in use, when a cutting tool breaks at the shaft, the shaft of a cutting tool can either:

pass through the channel of the holder, through the aperture seating the holder and into said cavity, so that the shaft of a new cutting tool can be received in the holder, or be pressed through the aperture and away from the cavity for removal and replacement with a new cutting tool.

According to the present invention there is also provided a cutting apparatus which includes.

a rotatable member having a helical housing and an outer surface and a plurality of receiving means for receiving shafts of cutting tools, wherein, in use, cutting tools are mounted via their shafts in the receiving means so that the receiving means are shielded by the portion of the helical housing defining the outer surface, and wherein, in use, the rotating outer surface of the helical housing rides over the surface being removed with the cutting tools extending radially beyond the outer surface a sufficient distance to operate as cutters so that cutting force is applied to the surface being cut by the cutting tools and not the outer surface of the helical housing.

According to the present invention there is also provided a cutting apparatus including a rotatable member having a helical upstanding ridge, an outer face and apertures for receiving and seating cutting tools disposed about the helical upstanding ridge, the cutting tools each including a shaft and a tip, and the apertures being arranged so that cutting tools located in the apertures are positioned with tips of the cutting tools project radially outwardly of the outer face, wherein the helical upstanding ridge includes cavities opening to the apertures, so that, in use, when a cutting tool breaks at the shaft, the shaft of the cutting tool can either pass radially inwardly through the aperture and into said cavity, or can be pressed radially outwardly utilising access via the cavity, so that the shaft of a new cutting tool can be received in the holder.

Preferably, the apertures are formed in radially recessed regions of the helical upstanding ridge.

According to the present invention there is also provided a block for use on a cutting apparatus including a rotatable body and an outer surface, said block including:

a first surface for forming the outer surface of the cutting apparatus; and a receiving means for receiving a cutting tool assembly which comprises a cutting tool mounted in a holder, wherein the receiving means is positioned so that, in use, a holder located in the receiving means will be shielded by the first surface of the block, and the cutting tool will extend beyond the first surface of the block a sufficient distance to operate as a cutter.

As explained above with reference to the cutting apparatus, the holder may be separate to, or integral with the block.

A plurality of like blocks maybe mounted either directly or indirectly onto a rotatable drum to form a cutting apparatus having shielded holders.

Preferably the receiving means is recessed from the first surface of the block. Preferably, the receiving means is positioned to one side of the first surface of the block. Preferably the first surface of the block is arcuate in shape.

Preferably, the block includes a second surface adapted for mounting directly or indirectly to a rotatable drum. Preferably the block includes two opposite ends which interconnect the first and second surfaces of the block.

Preferably the block is shaped so that when two like blocks are positioned one next to the other, the first surface of one block is aligned with the first surface of the second block to define a substantially continuous outer surface. Accordingly, it is particularly preferred that the block be in the shape of a segment of a ring.

Preferably the receiving means comprises an aperture, in which the cutting tool assembly can be seated.

Preferably the block includes a cavity located to one end of the aperture defining the receiving means, such that, in use, when a cutting tool breaks, a shaft of the cutting tool can either;

pass through the aperture and to the cavity to facilitate removal of the broken cutting tool and replacement with a new cutting tool, or be pressed through the aperture away from the cavity for removal and replacement with a new cutting tool.

Preferably the block includes two opposite side walls. More preferably, the opposite side walls of the block are dimensioned so that when two like blocks are positioned one next to the other, the side walls of the adjacent blocks are substantially aligned.

According to the present invention there is also provided a block for use on a cutting apparatus including a rotatable body and an outer surface, said block including:

a first arcuate surface for forming the outer surface of the cutting apparatus; and an aperture for receiving and seating a cutting tool assembly which comprises a cutting tool mounted in a holder, the aperture being located to one side of the first arcuate surface so that the holder will be shielded by the portion of the block defining the arcuate surface and the cutting tool will extend beyond the first arcuate surface of the block a sufficient distance to operate as a cutter.

According to the present invention there in also provided a block for use on a cutting apparatus including a rotatable body and an outer surface, said block including:

a first surface for forming the outer surface of the cutting apparatus;

a second surface opposite the first surface adapted for mounting directly or indirectly onto a rotatable drum, a pair of opposite ends interconnecting the first and second surfaces, a pair of opposite side walls, and a recessed region adjacent or within the first surface, said recessed region including an aperture for receiving and seating a cutting tool assembly which comprises a cutting tool mounted in a holder, the aperture being positioned to seat the cutting tool so that the tip of the cutting tool extends outwardly beyond the first surface of the block.

According to the present invention there is also provided a method of retro-fitting a cutting apparatus including a rotatable body to provide a cutting apparatus having shielded holders or holder regions, the method including steps of:

(i) removing the outer profile of the rotatable body to obtain a stripped rotatable body; and (ii) mounting the stripped rotatable body of step (i) with the blocks described above.

The removal of the outer profile of the rotatable body may be effected by machining the outer profile of the body to obtain a curved surface, and mounting blocks onto the machine-curved surface. Alternatively, the rotatable body of the cutting apparatus may be stripped back to the rotatable drum, and the blocks mounted directly onto the rotatable drum.

The present invention will now be described in further detail by reference to the accompanying drawings in which.

Figure 14:
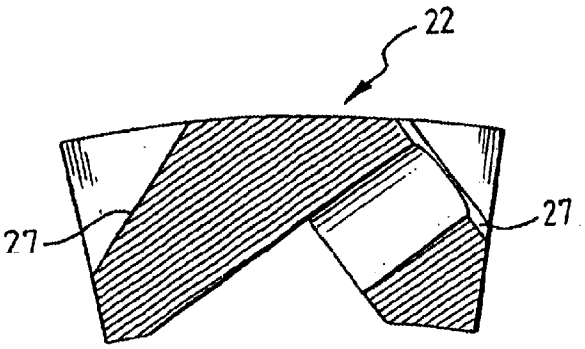
FIG. 14 is a side cross-section of the block illustrated in FIG. 13.
Figure 16:
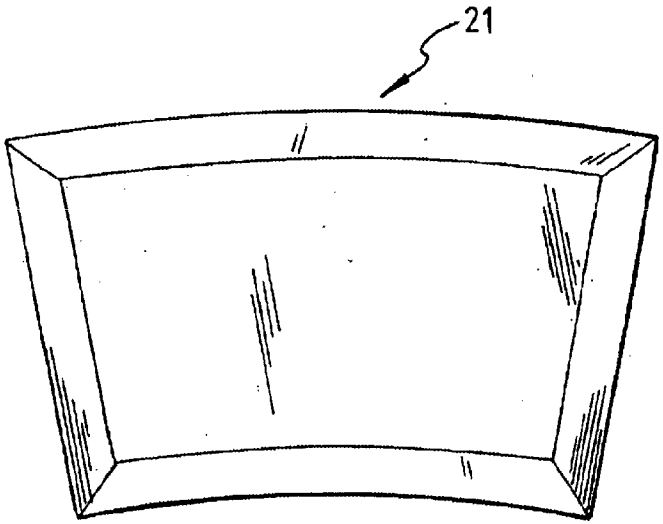
Figure 13:
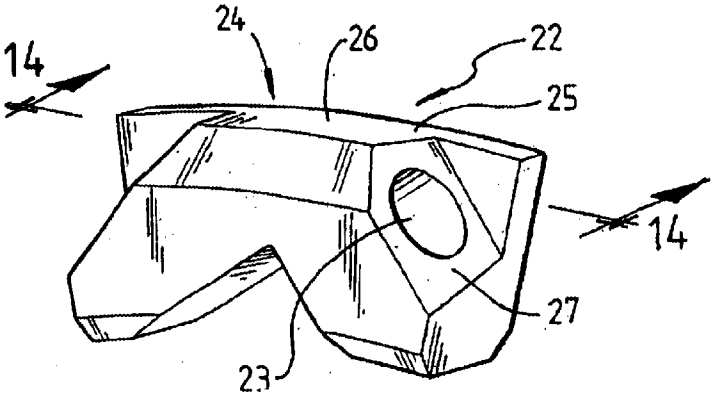
FIG. 13 is a perspective view of a block of a third embodiment of the invention.
Figure 15:
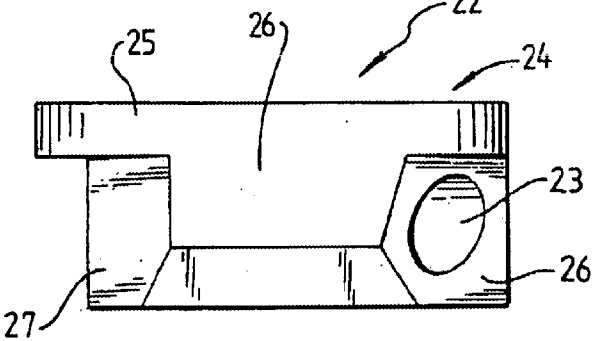
Figure 17:
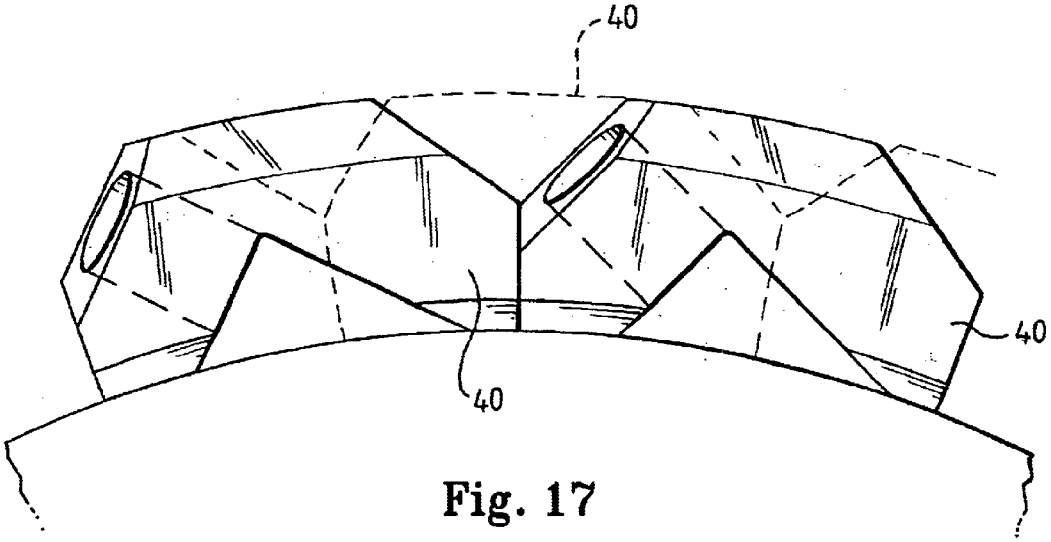
Figure 18:
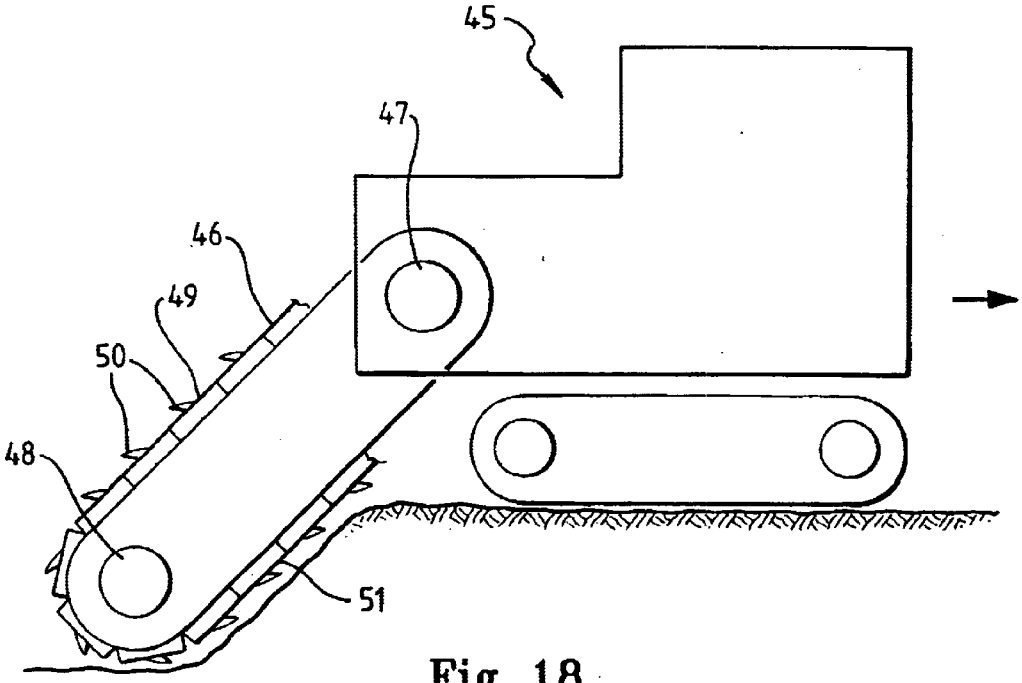
Figure 19:
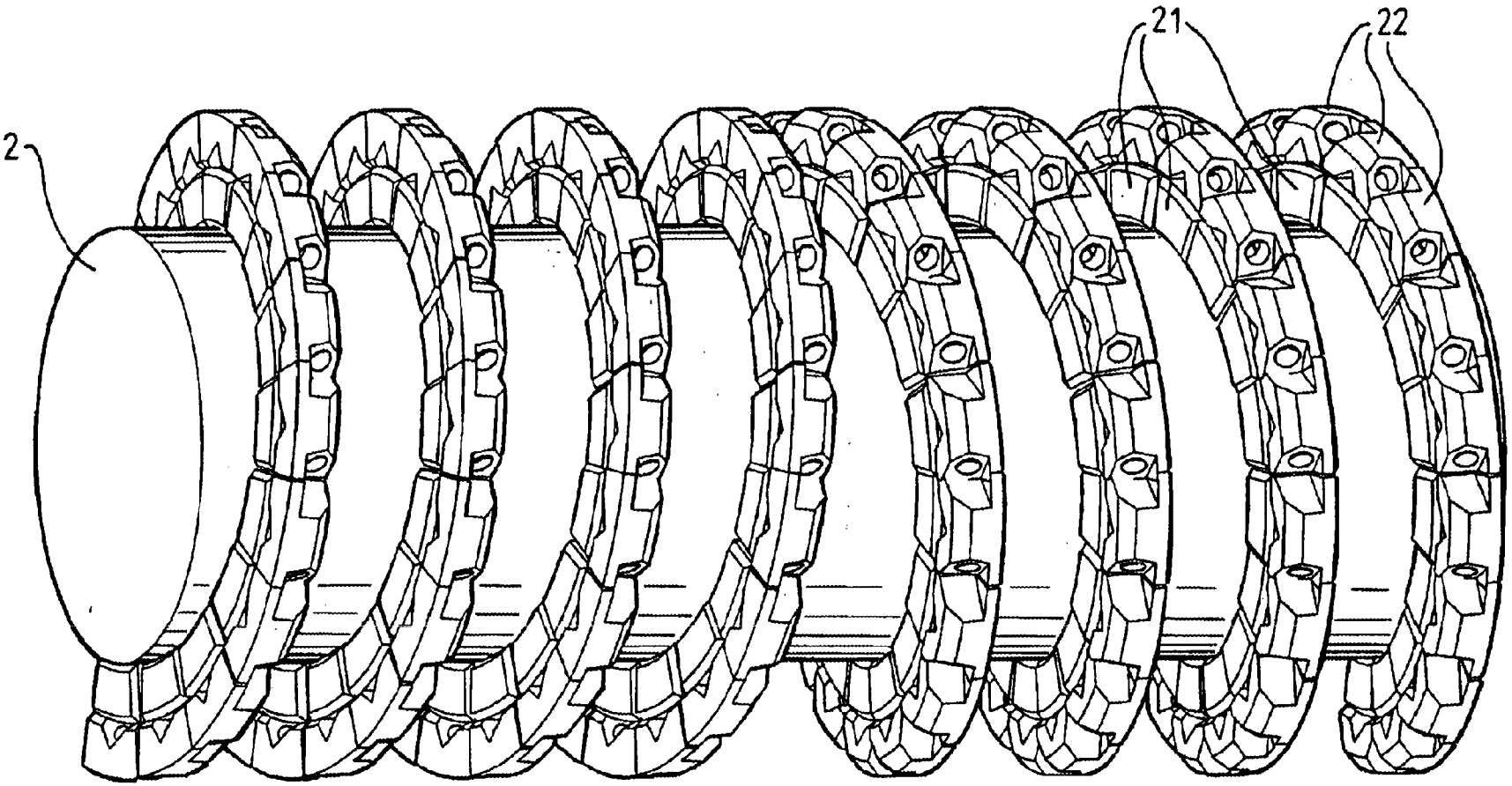
Figure 20:
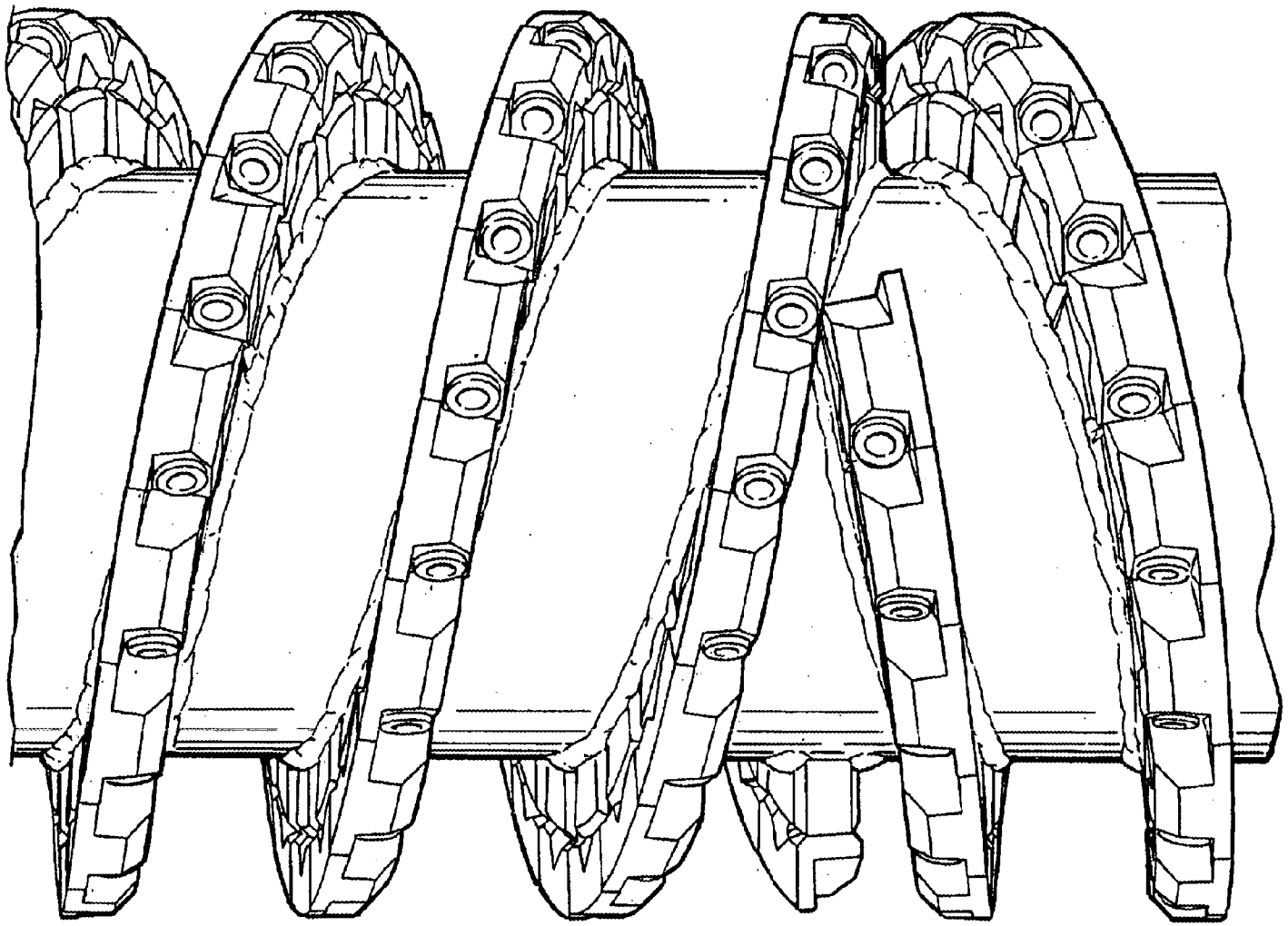

FIG. 15 in a plan view of the block illustrated in FIG. 13;

FIG. 16 is a side view of a basic block for use an conjunction with the block of FIGS. 13–15;

FIG. 17 is a side schematic view of two blocks of a fourth embodiment of the invention;

FIG. 18 is a side schematic view of a trench digging machine with a cutting apparatus according to a fifth embodiment of the invention;

FIG. 19 is a perspective view of a cutting apparatus marked with the blocks of FIGS. 13 and 16; and FIG. 20 is a photographic view of a part of the cutting apparatus illustrated in FIG. 19.

The cutting apparatus of the prior art 100 includes a rotatable drum 102 and a series of holders or blocks 104 mounted onto the rotatable drum. Cutting tools 106 are mounted with spring clips 108 in the holders 104.

The holders 104 are not shielded by any elements of the cutting apparatus; the surface being cut strikes the whole of the protruding holder 104 and cutting tool 106. This renders the holder 104 liable to be broken off at its base.

The cutting apparatus 1 of a first preferred embodiment of the present invention includes a rotatable member in the form of a combination of a rotatable drum 2 and a housing comprising a plurality of blocks 3. Each of the blocks 3 includes an aperture 4 which is circular in cross section for receiving a cutting tool assembly including a cutting tool 5 mounted in a holder 6.

The rotatable drum 2 of the preferred embodiments illustrated is generally cylindrical in shape. Each of the blocks 3 includes a first outer surface 7 for forming the outer surface of the cutting apparatus, and a second surface 14 opposite to the first surface shaped so as to enable mounting of the block directly onto the rotatable drum 2. Since the rotatable drum is cylindrical in shape, this second surface has a constant rate of curvature such that it will be aligned for mounting directly onto the cylindrical surface of the rotatable drum 2.

The first outer surface 7 of the block 3 includes a radially outer portion 8 which defines the outer surface of the rotatable body, and an angled portion 9 which includes the receiving aperture 4 for receiving the cutting tool assembly 5, 6. The receiving aperture 4 is positioned so that the holder 6 is located in the block so as to be shielded by the radially outer portion 8 of the block, with the tip of the cutting tool 5 extending beyond the radially outer portion 8 of the block a sufficient distance to operate as a cutter. In particular, it is the region marked by numeral 20 that shields the holder.

Figure 3:
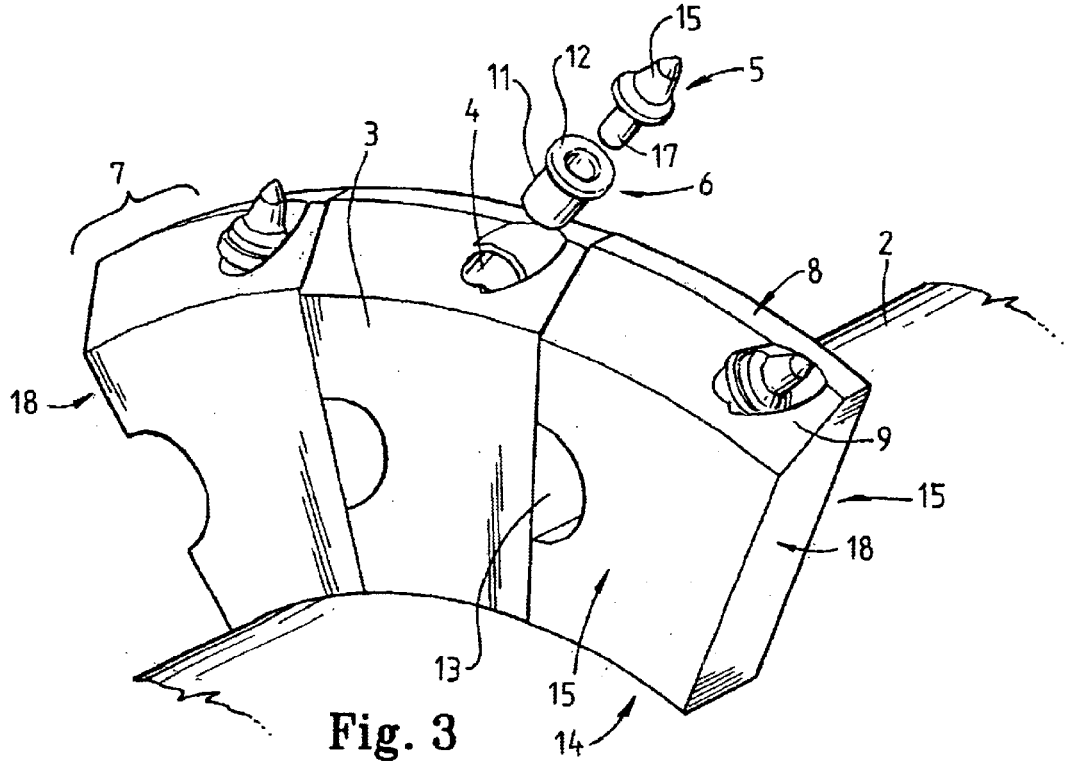
FIG. 3 is a schematic perspective view from above of three of the blocks on the rotatable drum of the preferred embodiment illustrated in FIG. 2.
Figure 4:
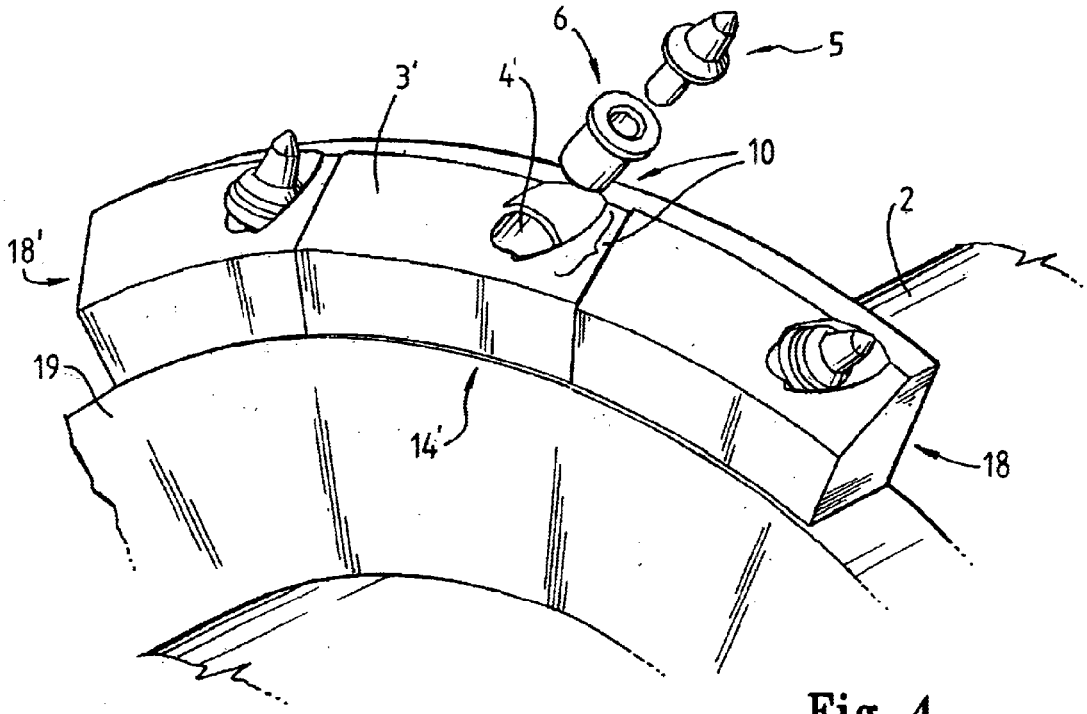
FIG. 4 is a schematic view corresponding to that shown in FIG. 3 of the cutting apparatus of a second preferred embodiment of the present invention.
Figure 5:
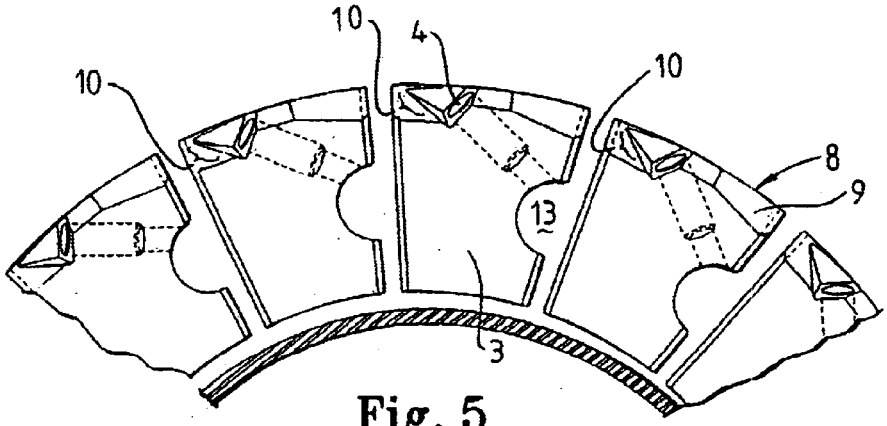
FIG. 5 is a schematic side cross section of the cutting apparatus of the preferred embodiment illustrated in FIG. 2.
Figure 6:
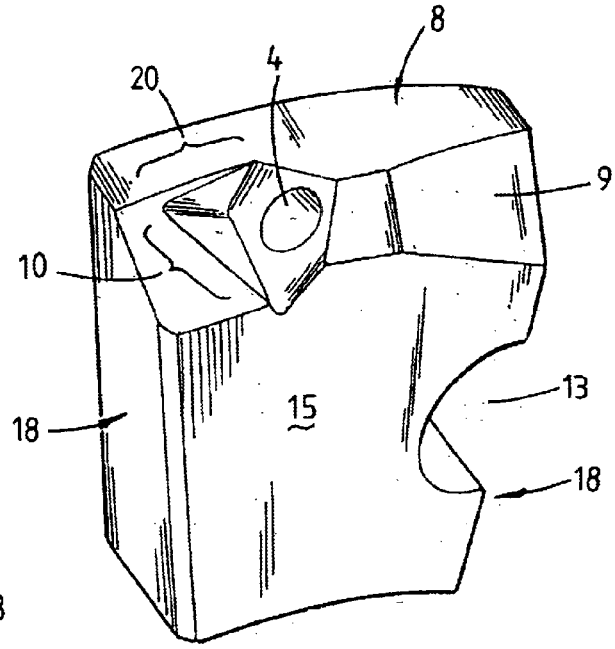
FIG. 6 is a perspective view of a block used on the cutting apparatus in accordance with the first preferred embodiment of the invention illustrated schematically in FIG. 2.
Figure 7:
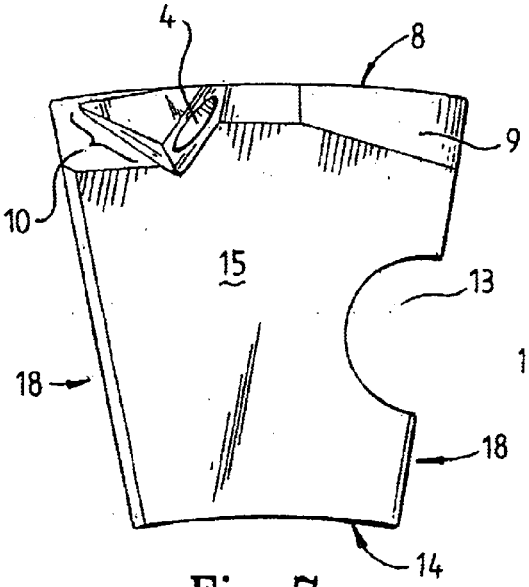
FIG. 7 is a side view of the block illustrated in FIG. 6.
Figure 8:
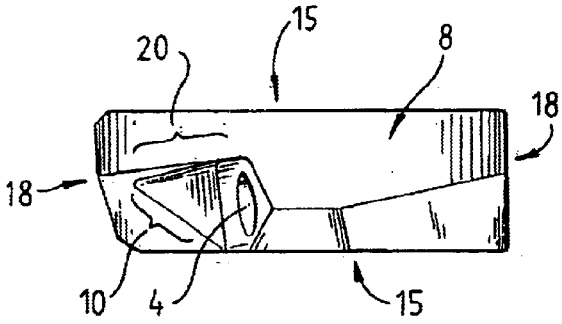
FIG. 8 is a plan view of the block illustrated in FIG. 6.
Figure 9:
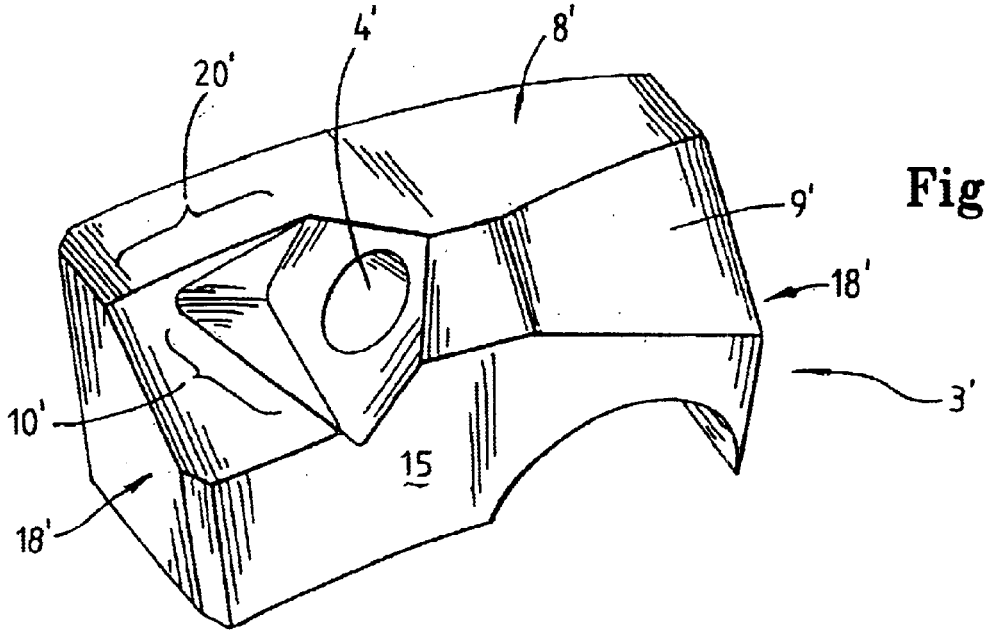
FIG. 9 is a perspective view of the block of the second preferred embodiment of the invention illustrated in FIG. 4.
Figure 10:
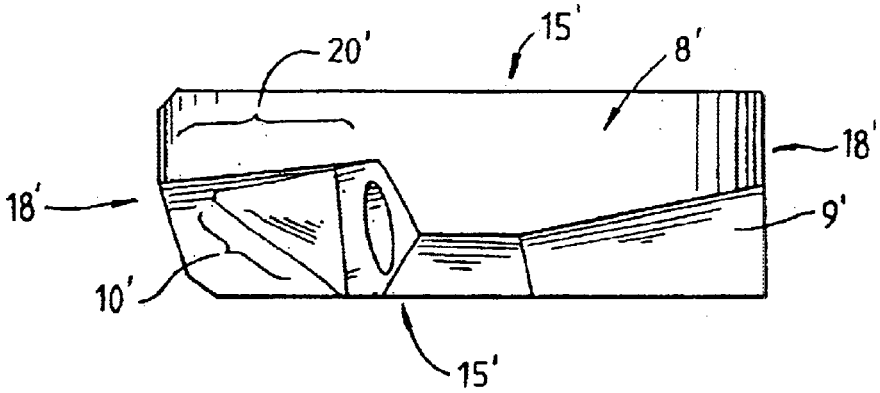
FIG. 10 is a plan view of the block illustrated in FIG. 9.
Figure 11:
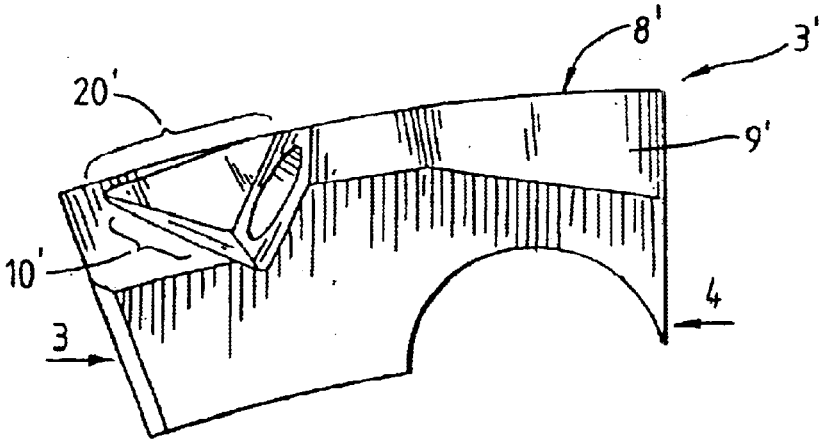
FIG. 11 is a side view of the block illustrated in FIG. 9.

As is best illustrated in FIGS. 3 and 5, the axis of the cylindrical receiving aperture 4 of the block 3 is angled at a 40° angle to the tangent of the curved radially outer surface 8 of the block.

The holder 6 is also shielded by the region of the block which immediately precedes the cylindrical aperture 4 which receives the holder in the direction of rotation of the cutting apparatus, this region being generally indicated by the numeral 10.

The radially outer portion 8 of each of the blocks 3 is arcuate in shape, such that when like two-like blocks are mounted to the rotatable drum 2 the outer surface is substantially continuous. Whilst it is preferred that the outer surface be completely continuous, it is relatively difficult to achieve a completely continuous surface since the welded joints between the blocks may not lie flush with the radially outer portion 8 of each block. In addition, as is explained below with reference to other embodiments of the invention, any small break or gap in the continuity of the outer surface may be compensated for overall by other segments of the outer surface of the housing of the rotatable member. Accordingly, it is sufficient if the radially outer surface 8 of the rotatable member is sufficiently continuous or regular such that the amount of strain placed on the drive mechanism as a result of impact of any projecting components of the cutting apparatus with the surface being cut is minimised as compared with known cutting assemblies. It has been found by the applicant that the provision of a substantially continuous or regular outer surface of the rotatable member with only the tips of the cutting tools 5 extending beyond this outer surface forms a cutting apparatus which places minimal strain on the drive mechanism of the cutting machine. The cutting apparatus accordingly provides substantial advantages over known apparatus in which there is a much greater risk of damaging the drive mechanism. This maximises the amount of time during which the cutting machine is up and running.

Figure 2:
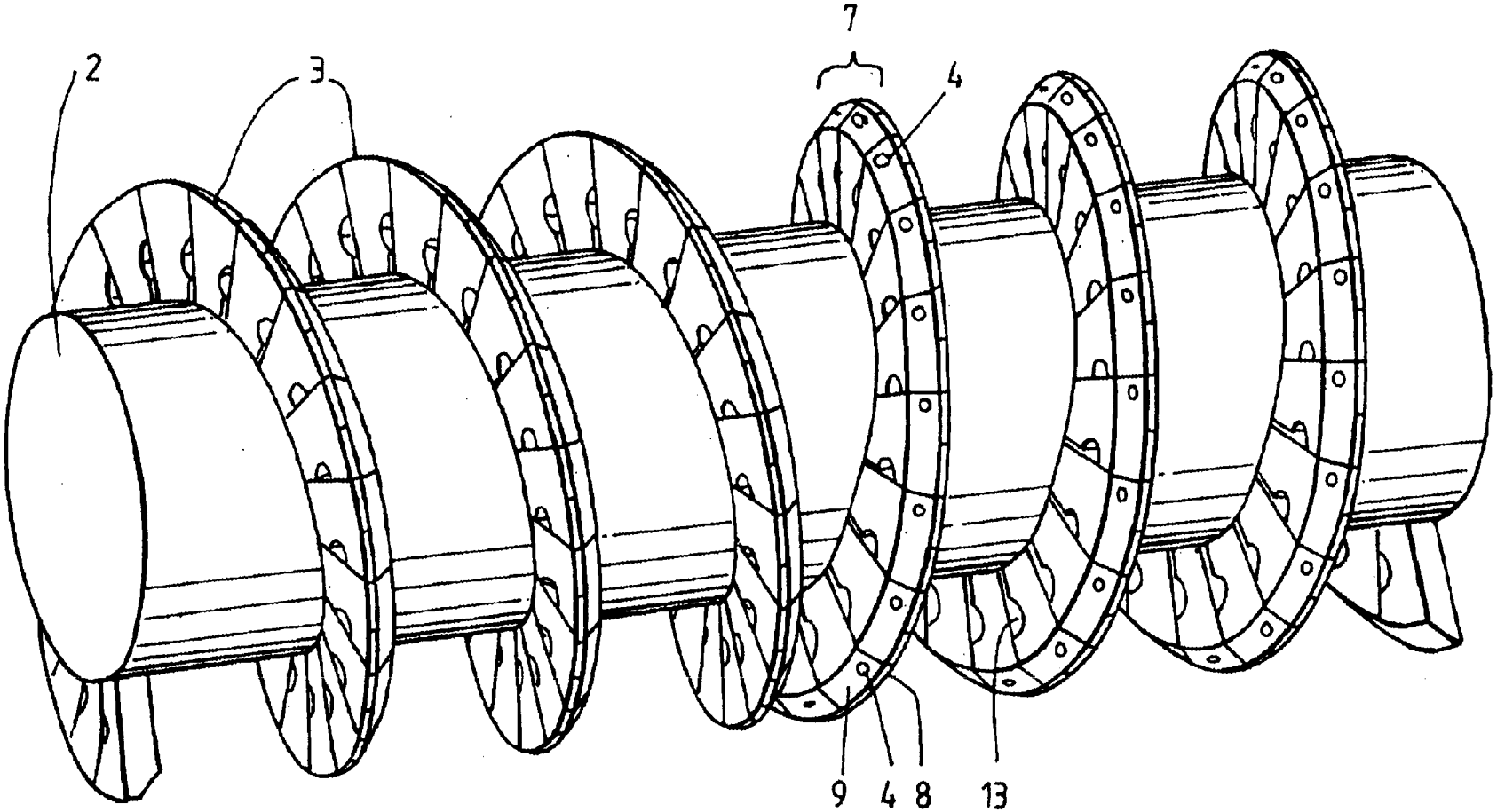
FIG. 2 is a schematic front perspective view of the cutting apparatus including a rotatable drum and blocks of one preferred embodiment of the invention.

As is illustrated in FIG. 2, the blocks are shaped so that the outer surface of the cutting apparatus 1 forms a spiral or helix. The outer surface of a cutting apparatus forms two helices which start at the outer edges of the drum and wind inwardly towards the centre of the drum. Of course, if the rotatable member is not in the shape of a drum, for example for a rotatable member of a "pineapple" configuration, the outer surface of the cutting apparatus is preferable spiral in shape winding from the head of the rotatable member to the base.

Figure 12:
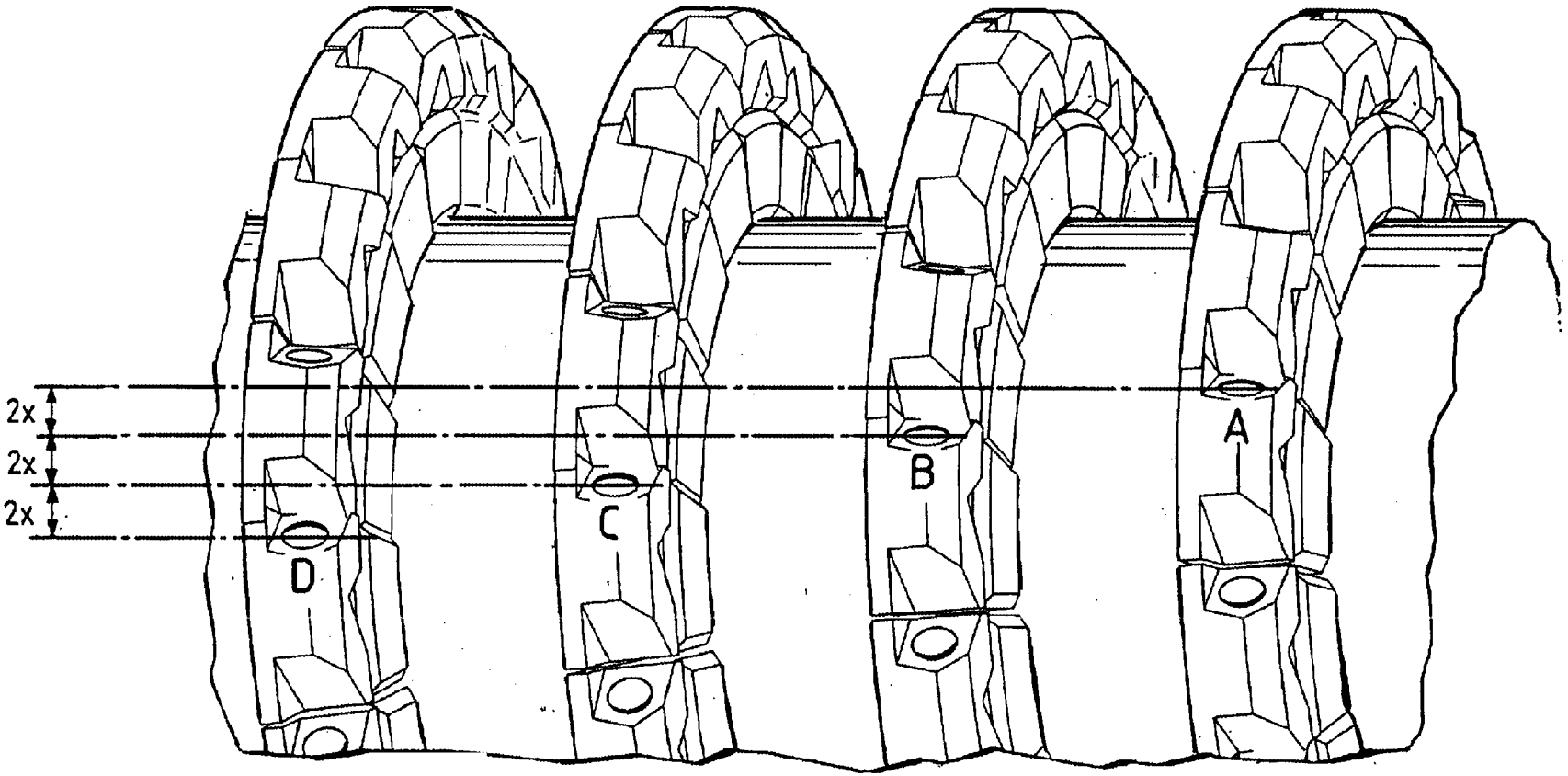
FIG. 12 is a photographic perspective view of a portion of the cutting apparatus of the preferred embodiment of the invention illustrated schematically in FIG. 2.

As is illustrated in FIGS. 2 and 12, it is preferred that the cutting tool assemblies and in particular the cutting tools are evenly circumferentially distributed along the surface of the cutting apparatus. This arrangement further minimises the stress placed on the drive mechanism since the cutting tools will strike the surface being cut evenly so that, firstly, only one cutting tool strikes the surface being cut at a time, and secondly, there is an even time period between each subsequent cutting tool striking the surface being cut. When this cutting apparatus is in operation, the sound made by the machine as each cutting tool strikes the surface being cut is an even "tap..tap..tap..tap". Known cutting machines have unevenly randomly placed cutting tools so that several tools may strike the surface at one time. There are also uneven time periods between the points at which each following tool strikes the surface. The sound made by this machine my be "TAP....tap.tap...TAP...TAP.....tap". The unevenness of the forces applied to the cutting apparatus and the drive mechanism of this machine of the prior art causes significant stress and damage. It is particularly preferred that cutting tools be placed at even distances along the two helices on the cutting drum so that even loading is placed to either end of the cylindrical rotating drum 2.

FIG. 12 illustrates just less than one half of the cutting apparatus of the preferred embodiment of the invention. Four of the apertures 4 for receiving the cutting holders and cutting tools on this half of the apparatus are marked by the letters A, B, C and D.

When the cutting apparatus is rotated, a cutting tool in aperture A strikes the surface being cut first out of the four apertures marked. After a time period $T_1$ a cutting tool in a holder on the other half of the apparatus A' (not illustrated) strikes the cutting surface. Following an approximately equal time period $T_1$, a cutting tool in aperture B will strike the surface, followed by a cutting tool on the other half of the apparatus B' and so on with C, C', D an D'.

The circumferential distance X between the two successive cutting tools on the apparatus which strike the surface being cut one after the other is equal for most or all of the cutting tools. Accordingly, for the apertures A–D illustrated, which strike the surface being cut every second ties in the sequence described, the circumferential distance between each of these apertures is equal to 2×.

The holder 6 of the cutting tool assembly is made from higher grade steel (tool steel) than the block. The holder 6 includes a generally cylindrical body portion 11 having a central channel and a lip 12 around one cylindrical end of the body 11. The holder is located in the cylindrical aperture 4 of the block 3 by freeze-fitting. The body portion 11 of the holder 6 is 2/1000th of an inch oversized compared to the cylindrical aperture 4 in the block. The holder 6 is reduced in temperature to a sufficient extent to contract the size of the holder for location with in the cylindrical aperture 4 of the block 3. When the temperature of the holder returns to ambient, it will be firmly located with in the cylindrical aperture 4 in the block. The holder can be removed when necessary by running a weld line down the inside of the holder to shrink the holder.

It is of course also possible (although usually more expensive) to provide a block that is made completely from high grade tool steel, so that a separate holder is not mounted in the aperture 4 of the block. In this embodiment of the invention, the (integral) holder is the region of the block (or rotatable member) that receives and supports the shaft of the cutting tool. This region would roughly correspond in size to the separate holders in the preferred embodiments illustrated. Accordingly, any references to the holder throughout the specification should be read broadly to cover holders that are separate to or integral with the rotatable member.

The block 3 also includes a cavity 13 located to an inner end of the aperture 4 defining the receiving means. This cavity 13 has a semi-circular cross-section and opens to the two opposite side walls 15 of the block.

Figure 1:
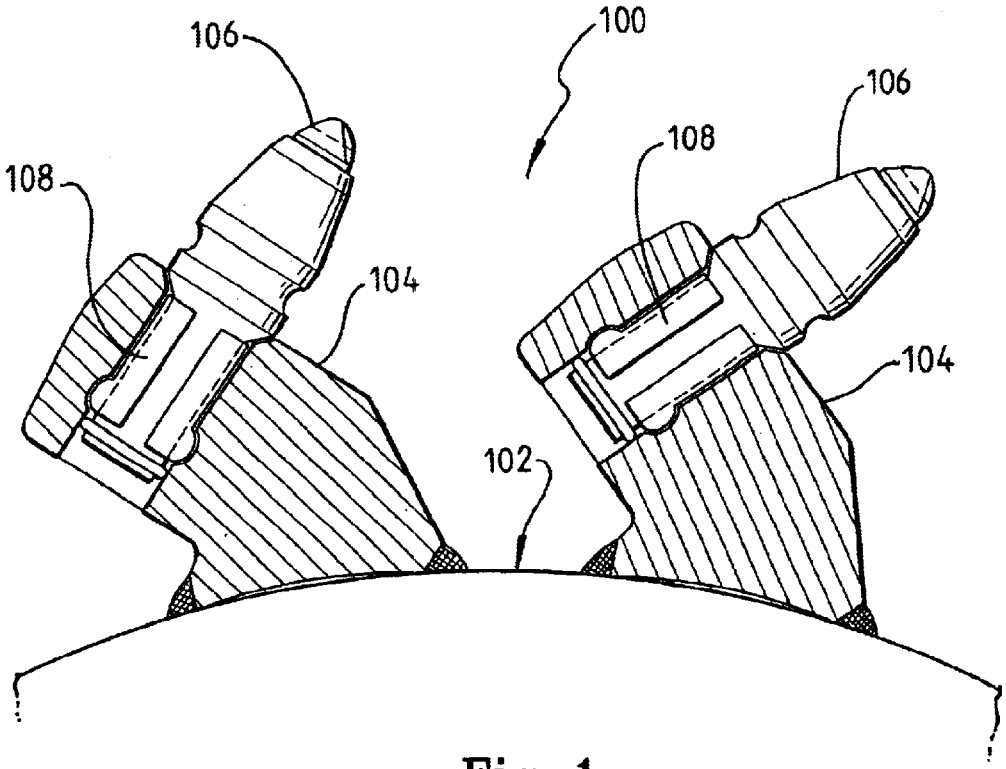
Fig. 1 Prior Art
FIG. 1 is a side cross-section of a cutting apparatus of the prior art.

The cutting tool 5 includes a cutting tool tip 16 and a shank 17 which is received within the cylindrical body 11 of the holder 6. The cutting tool 5 is held in place by a spring clip (not illustrated, but corresponding to that of the prior art illustrated in FIG. 1). The shank 17 of the cutting tool 5 includes a groove (not illustrated) at one end adjacent the cutting tip 16 which defines a sheer point. In use, when a cutting tool 5 strikes a particularly hard object, the cutting tool will break at this sheer point. The tip 16 of the cutting tool 5 will have broken away from the cutting apparatus and the shank 17 may fall through the aperture 4 and into the cavity 13 of the block from which it comes away entirely from the cutting apparatus 1. Thereafter, a new cutting tool 5 can be received in the channel of the holder 6. Otherwise, if the shaft does not fall through the aperture 4 into the cavity 13, the cavity can be used to gain access to the aperture to poke or press the shaft radially outwardly. A poker can be used for this purpose. The cavity might therefore be of a size to allow access by the poker and/or a hand.

In one application of the invention, the cutting apparatus is used to remove a road surface. If during removal of the road surface the cutting apparatus comes into contact with a particularly hard obstruction such as a drain covering or a steel track, the cutting tools will break as described above, and the cutting apparatus will continue to rotate maintaining continuous and smooth contact with the obstruction. This enables the apparatus to roll over the obstruction without any further damage to either the holders (which are shielded) or the drive mechanism. It is a simple matter then to replace the broken cutting tools.

The housing of the cutting apparatus comprising the series of blocks 3 has a side surface defined by the opposite side walls of the blocks 15 which is substantially continuous. Where the housing is formed from a series of blocks, the side walls of adjacent blocks are substantially aligned so as to define a substantially continuous or substantially constant side surface of the housing. This substantially constant side surface of the housing is advantageous since it minimises the drag caused by the excavated material on the cutting apparatus. In the known cutting apparatus of the prior art, there is significant drag force acting on the cutting apparatus since the broken up excavated material which builds up in the region between the mounting blocks and the rotating drum causes drag on the cutting apparatus when the bulky mounting blocks and holders of the apparatus strike this material. However, by providing a substantially continuous or constant side wall surface, the amount of drag is minimised and the material flows through the spiral passageway defined by the side walls of the blocks to a central part of the drum 2. The machine includes a central conveyor (not illustrated) which draws the excavated material away from the cutting apparatus.

As can be seen from the figures, each of the blocks may be considered to constitute a segment of a ring, having an arcuate radially outer portion of the first outer surface 8 and a second arcuate radially inner surface 14 adapted for mounting directly or indirectly onto the rotatable drum 2, two opposite ends 18 and two opposite sides 15.

The cutting apparatus or the present invention may be manufactured by mounting a series of like blocks 3 onto a rotatable drum 2 by welding each of the blocks to the rotatable drum and to each adjacent block so as to define a housing in the form of two helices which extends from a central region of the rotatable drum 2 to an outer region of the rotatable drum.

According to a second preferred embodiment of the invention, there is provided an alternative form of block 3' which can be used to form a cutting apparatus by retro-fitting a standard cutting apparatus. The second form of block 3' includes all of the features described above in relation to the first form of the cutting block 3.

A known cutting apparatus can be retro-fitted by removing the outer profile of the rotatable body of the known cutting apparatus (for example, by machining the outer profile of this body) to obtain a stripped rotatable body 19, and mounting the stripped rotatable body with block 3'. When machining the outer profile of the rotatable body to obtain a stripped rotatable body, it is desirable to machine the outer profile of this body to obtain a surface which corresponds to the second radially inner surface 14' of the block 3'. In the preferred embodiment illustrated, a curved or arcuate outer profile is machined. Alternatively, the rotatable body of the cutting apparatus of the prior art may be stripped back to the rotatable drum, and the blocks 3 of the first preferred embodiment of the invention can be mounted directly onto this rotatable drum.

According to a third alternative embodiment of the invention, there is provided two types of block for mounting in combination on to a drum, namely a basic block 21 and a contour block 22. The basic blocks are mounted on to the blank drum in the desired helical arrangement, so that contour blocks 22 can be mounted thereto.

The contour blocks 22 generally include each of the features of the block of the first embodiment of the invention. The contour blocks 22 include an aperture 23 which is circular in cross-section for receiving a cutting tool or cutting tool assembly including a cutting tool 5 mounted in a holder 6. The contour block 22 also includes a curved outer surface 24. This outer surface 24 forms the outer surface of the cutting apparatus when mounted on to the rotatable drum via the basic blocks 21.

The outer surface 24 includes a curved linear arcuate section 25 and a wider shoulder region 26. The aperture 23 is formed in a bevelled surface 27 adjacent the shoulder region 26 and the curved linear arcuate section 25.

As is illustrated in FIG. 13, the receiving aperture 23 is positioned so that the holder 6 will be located in the block so as to be shielded by the curved linear arcuate section 25 of the outer surface 24, with the tip of the cutting tool 5 extending beyond this arcuate section 25 a sufficient distance to operate as a cutter. Ideally, the opposite ends of the curved linear arcuate section 24 which lie adjacent the bevelled end faces 27 of the contour block 22 are wide enough to provide structural integrity sufficient to prevent breaking, thereby providing sufficient shielding of the holder.

With reference to the Figures, it can be seen that the spiralling outer surface forms an angle of approximately 12° with the tangential surface of the drum. The apertures 4,20 of the blocks are also at an angle of 7° to the side face 15 of the block. Therefore, the tools of the cutting assemblies strike the surface being out at a total 19° angle to the tangential direction of rotation of the drum.

In view of the fact that the blocks spiral around the drum at an single of around 12° to the tangential direction of rotation of the drum, the radially outer portions 8,24 of the blocks provide shielding of the holders as the cutting tools strike the surface being cut. The shank of the cutting tool and the region of the holder (or the region of the block) receiving the shank are housed within the body of the block. The structural integrity of the block parts surrounding the aperture receiving the holder and tool shank impart further strengthening qualities on the cutting apparatus. Since the blocks do not include any protruding bulky regions, there is little likelihood of any of the blocks being knocked-off the drum when the outer surface of the cutting tool strikes bard obstructions. Indeed, the design of the outer surface enables the outer surface to roll over the surface being cut, with only the cutting tools extending outwardly to cut the surface being cut.

A fourth embodiment of the invention is illustrated in FIG. 17. The blocks 40 of this embodiment of the invention are arranged in a helical pattern corresponding to that of the three embodiments described above. However, the apertures for receiving the holders or defining the holder regions are not arranged to one side of the helical outer surface. They are recessed into the helical outer surface in alignment with the helical outer surface.

The tips of the cutting-tools will extend beyond the radial outer surface of the rotatable member. In particular, the tips of the cutting tools will extend beyond the radial outer surface defined by the sum of the super-imposed blocks (when viewed from the side).

In FIG. 17, the short dashed lines represent the block in the next revolution of the helical housing of the rotatable member. Because of the overlapping of the blocks and even staggering of the cutting tools about the surface of the rotatable member, at the time when a cutting tool mounted in the illustrated blocks in the foreground strikes the surface being cut, corresponding regions of the rotatable member also at the surface being cut will keep the drum smoothly rolling on the outer surface over the surface being cut. The rotatable member maintains continuous contact with the surface being cut via the other sections laterally in line with this point in the other turns of the helix. Provided any gaps in the outer surface to allow tools to extend out from the outer surface are compensated for by regions of the outer surface of the rotatable member laterally in line with that gap, the rotatable member will operate in the required way. Specifically, the cutting tools only will provide the cutting force on the surface being cut, and not the rotating housing that holds the cutting tools. The location of the cutting tools about the rotatable member is such that there is balanced, smooth continuous contact between the rotatable member and the surface being cut.

The concept of the present invention is broadly applicable to various types of cutting apparatus. FIG. 18 illustrates a trench digger 45 having a rotatable element in the form of a rotary digging chain 46. The digging chain 46 is driven at the upper end by a digging chain drive 47, and passes at the lower end over a tail wheel 48. The digging chain is made up of a series of plates bearing cutting tools 50. The cutting tools of this rotating cutting member can be provided with the type of shielding envisaged in the present invention, such that only the tips of the cutting tools extend beyond the outer surface 51 of the rotatable member, when striking the surface being cut. The shielding need not be in existence when the cutting tools are not striking the surface being cut. Accordingly, when the plates separate to pass over the tail wheel, the shielding of the present invention need not be present, provided it is present substantially over the region when the cutting tools are operating as cutters.

Many other modifications may be made to the cutting apparatus described above without departing from the spirit and scope of the present invention.

For example, the rotatable member may include a helical steel rim which extends around or between the mounting blocks, said steel rim acting to shield the holder in such a way that the cutting tool extends beyond the outer surface defined by the steel rim. By providing such a steel rim, it would not be necessary for the adjacent mounting blocks to be connected one to the other, provided that the steel rim shields the holders from direct contact with the surface being cut.

For another example, the housing need not be formed from individual blocks which are welded to each other and to the rotatable drum. Instead, it is possible to manufacture a cutting apparatus having an integral, single-unit housing component. Alternatively, the blocks for mounting to the rotatable drum may include two or more spaced apart cutting tool assemblies instead of the one cutting tool assembly illustrated.

For a further example, the outer surface of the cutting apparatus may be in the form of a single helix which winds around the drum from one side to another, or may include a number of interposed or meshing helices which wind from one side of the drum to the other, or from a central region outwardly. According to these variations, a conveyor may not be required in the cutting machine.

What is claimed is:

1. A cutting apparatus, the cutting apparatus comprising:

a rotatable member having an outer surface; and a plurality of cutting tool assemblies, each assembly including a cutting tool mounted in a holder, the holders received within an aperture formed in the rotatable member, the aperture having a first end, a second end, and a cavity disposed adjacent to the second end, the cavity having a width dimension greater than the width of a shaft of the cutting tool and a length greater than the length of the shaft of the cutting tool, wherein the cutting tool assemblies are mounted on the rotatable member so that the holders are shielded by the rotatable member, the cutting tools extending beyond the outer surface of the rotatable member a sufficient distance to operate as a cutter.

2. The cutting apparatus as claimed in claim 1, wherein each of the holders are separate to the rotatable member.

3. The cutting apparatus as claimed in claim 1, wherein the holders are integral with the rotatable member.

4. The cutting apparatus as claimed in claim 1, wherein shielding is provided in a region to the side of and in front of each of the holders in the direction of rotation of the rotatable member.

5. The cutting apparatus as claimed in claim 4, wherein the shielding is provided in a region diagonally in front and to the side of the holders, in the direction of rotation of the rotational member.

6. The cutting apparatus as claimed in claim 1, wherein the portion of the rotatable member defining the outer surface shields the holders.

7. The cutting apparatus as claimed in claim 1, wherein the outer surface of the rotatable member is substantially continuous.

8. The cutting apparatus as claimed in claim 1, wherein the outer surface of the rotatable member is shaped to enable the rotatable member to make continuous contact with the surface being cut as it rotates in a cutting operation.

9. The cutting apparatus as claimed in claim 8 wherein the rotatable member is able to maintain smooth continuous contact with the surface being cut during the cutting operation.

10. The cutting apparatus as claimed in claim 1, wherein the outer surface of the cutting apparatus forms a spiral or helix.

11. The cutting apparatus as claimed in claim 10 wherein the outer surface has a constant radius from the axis of rotation.

12. The cutting apparatus as claimed in claim 10 wherein the outer surface includes a sufficient number of sections extending around the rotatable member having a uniform radius to enable the rotatable member to maintain continuous smooth contact with the surface being cut.

13. The cutting apparatus as claimed in claim 1, wherein the cutting tools are evenly distributed about the surface of the cutting apparatus.

14. The cutting apparatus as claimed in claim 1 wherein the rotatable member comprises a rotatable drum and a housing mounted to the drum, and the outer surface of the housing forms the outer surface of the rotatable member.

15. The cutting apparatus as claimed in claim 14, wherein the housing of the cutting apparatus has a side surface that is substantially constant.

16. The cutting apparatus as claimed in claim 14, wherein the housing includes a series of blocks, each bearing one of the cutting tool assemblies.

17. The cutting apparatus as claimed in claim 16, wherein each block constitutes a segment of a ring.

18. The cutting apparatus as claimed in claim 14, wherein the rotatable member is in the form of a drum having an upstanding ridge with a helical outer face.

19. The cutting apparatus as claimed in claim 14, wherein the drum is cylindrical, and the radial distance from the axis of the rotatable drum to the outer surface of the housing is substantially constant along the length of the rotatable drum.

20. The cutting apparatus as claimed in claim 1, wherein the holders further include a channel, the channel configured to receive the shaft of each of the cutting tools to enable mounting of the cutting tools in the holders.

21. The cutting apparatus as claimed in claim 20, wherein the aperture in which the holders are seated is aligned with the channel in the holders.

22. The cutting apparatus as claimed in claim 21, wherein in use, when the cutting tool breaks at the shaft, the shaft of the cutting tool can either;

pass through the channel of the holder, through the aperture seating the holder and into said cavity, so that the shaft of a new cutting tool can be received in the holder, or be pressed through the aperture and away from the cavity for removal and replacement with a new cutting tool.

23. The cutting apparatus as claimed in claim 1, wherein the cutting tool forms an angle of less than 90 degrees with the axis of rotation of the rotatable member.

24. A cutting apparatus including a rotatable member having a helical upstanding ridge, an outer face and apertures for receiving and seating cutting tools disposed about the helical upstanding ridge, the cutting tools each including a shaft and a tip, and the apertures being arranged so that cutting tools located in the apertures are positioned with tips of the cutting tools project radially outwardly of the outer face, wherein the helical upstanding ridge includes cavities aligned with and opening to the apertures, wherein the cavities have a width dimension greater that the width of the shaft of the cutting tool and a length greater than the shaft of the cutting tool, so that, in use, when a cutting tool breaks at the shaft, the shaft of the cutting tool can either pass radially inwardly through the aperture and into said cavity, or can be pressed radially outwardly utilising access via the cavity, so that the shaft of a new cutting tool can be received in the holder.

25. The cutting apparatus as claimed in claim 24, wherein the apertures are formed in a radially recessed region of the helical upstanding ridge.

26. A block for use on a cutting apparatus including a rotatable body and outer surface, said block including:

a first surface for forming the outer surface of the cutting apparatus; and a receiving means for receiving a cutting tool assembly, the cutting tool assembly including a holder and a cutting tool, the receiving means including a first end, a second end and a cavity disposed adjacent to the second end, the cavity having a width dimension greater than the width of a shaft of the cutting tool and a length greater than the length of the shaft of the cutting tool, wherein the receiving means is positioned so that, when a cutting tool assembly is positioned therein, the holder is located in the receiving means will be shielded by the first surface of the block, and the cutting tool will extend beyond the first surface of the block a sufficient distance to operate as a cutter.

27. The block as claimed in claim 26 wherein the receiving means is recessed from the first surface of the block.

28. The block as claimed in claim 26, wherein the receiving means is positioned to one side of the first surface of the block.

29. The block as claimed in claim 26, wherein the first surface of the block is arcuate in shape.

30. The block as claimed in claim 26, wherein the block includes a second surface adapted for mounting said block to a rotatable drum.

31. The block as claimed in claim 26, wherein the block is shaped so that when two like blocks are positioned one next to the other, the first surface of one block is aligned with the first surface of the second block to define a substantially continuous outer surface.

32. The block as claimed in claim 26, wherein the block is in the shape of a segment of a ring.

33. The block as claimed in claim 26, wherein the receiving means comprises an aperture, in which the cutting tool assembly can be seated.

34. The block as claimed in claim 33, wherein when a cutting tool breaks in use, the broken cutting tool can either:

pass through the aperture and into the cavity to facilitate removal of the broken cutting tool and replacement with a new cutting tool, or be pressed through the aperture away from the cavity for removal and replacement with a new cutting tool.

35. The block as claimed in claim 26, wherein the block includes two opposite side walls which are dimensioned so that when two like blocks are positioned one next to the other, the side walls of the adjacent blocks are substantially aligned.

36. A method of retro-fitting a cutting apparatus including a rotatable body the method including steps of:

(i) removing the outer profile of the rotatable body to obtain a stripped rotatable body; and (ii) mounting the stripped rotatable body of step (i) with the block as claimed in claim 26.

* * * * *